US011009810B2

(12) United States Patent
Okuda

(10) Patent No.: US 11,009,810 B2
(45) Date of Patent: May 18, 2021

(54) IMAGE FORMING APPARATUS

(71) Applicant: CANON KABUSHIKI KAISHA, Tokyo (JP)

(72) Inventor: Kazuhisa Okuda, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/091,129

(22) Filed: Nov. 6, 2020

(65) Prior Publication Data

US 2021/0055675 A1 Feb. 25, 2021

Related U.S. Application Data

(63) Continuation of application No. PCT/JP2019/021895, filed on May 28, 2019.

(30) Foreign Application Priority Data

Jun. 1, 2018 (JP) ..... JP2018-106497

(51) Int. Cl.
*G03G 15/10* (2006.01)
*G03G 15/08* (2006.01)
*G03G 15/01* (2006.01)

(52) U.S. Cl.
CPC ..... *G03G 15/104* (2013.01); *G03G 15/0121* (2013.01); *G03G 15/0865* (2013.01)

(58) Field of Classification Search
CPC ..... G03G 15/104; G03G 15/0865; G03G 15/0121
See application file for complete search history.

(56) References Cited

U.S. PATENT DOCUMENTS 3,461,788 A * 8/1969 Reick ..... G03G 15/108 396/626
4,994,860 A * 2/1991 Lunde ..... G03G 15/0121 396/626
5,156,308 A * 10/1992 Aoyama ..... G03G 15/104 222/145.5

(Continued)

FOREIGN PATENT DOCUMENTS

JP H5-313502 A 11/1993
JP 09190082 A * 7/1997

(Continued)

OTHER PUBLICATIONS

PCT International Search Report dated Jul. 16, 2019, in PCT/JP2019/021895.

*Primary Examiner* — Francis C Gray
(74) *Attorney, Agent, or Firm* — Venable LLP

(57) ABSTRACT

An image forming apparatus includes an apparatus main assembly, a drawer portion provided so as to be capable of being drawn out of the apparatus main assembly, an image forming portion, provided in the apparatus main assembly, for forming an image with a liquid developer containing toner and a carrier liquid, and a supply container accommodating one of toner for supply and a carrier liquid for supply. In addition, a unit is provided between the image forming portion and the supply container in a feeding passage of the liquid developer, and the supply container and the unit are provided in the drawer portion.

17 Claims, 12 Drawing Sheets

(56) References Cited

U.S. PATENT DOCUMENTS

| | | | | |
|---|---|---|---|---|
| 5,561,264 | A * | 10/1996 | Iino | G03G 15/101 399/240 |
| 5,918,093 | A | 6/1999 | Kim | |
| 10,451,991 | B2 | 10/2019 | Nagata et al. | |
| 2018/0107130 | A1* | 4/2018 | Nagata | G03G 15/104 |

FOREIGN PATENT DOCUMENTS

| | | | |
|---|---|---|---|
| JP | 2002-296915 | A | 10/2002 |
| JP | 2016-224133 | A | 12/2016 |
| JP | 2018-013630 | A | 1/2018 |

* cited by examiner (a)

(b)

IMAGE FORMING APPARATUS

This application is a continuation of PCT Application No. PCT/JP2019/021895, filed on May 28, 2019.

TECHNICAL FIELD

The present invention relates to an electrophotographic image forming apparatus for forming an image with a liquid developer.

BACKGROUND ART

Conventionally, the image forming apparatus for forming the image with the liquid developer containing toner and a carrier liquid has been known (Japanese Laid-Open Patent Application 2016-224133). In the case of the image forming apparatus using the liquid developer, the liquid developer is accommodated in a mixer and is supplied by a pump from the mixer to a developing device through a liquid sending pipe such as a liquid sending tube or a pipe, and is subjected to development. The liquid developer which is not subjected to development is returned to the mixer and is utilized again. That is, the liquid developer is circulated. However, the toner is consumed with the development, and further, a deteriorated carrier liquid is discharged as a waste liquid, and therefore, in order to maintain an amount of the liquid developer and a toner content (concentration), a user can supply (replenish) each of the toner and the carrier liquid. Toner for supply (replenishment) is accommodated in a toner tank and a carrier liquid for supply is accommodated in a carrier tank, respectively, and the user is capable of supplying the toner and the carrier liquid, respectively, by exchanging the respective tanks which emptied.

Incidentally, in the image forming apparatus using the liquid developer, in order to supply the toner for supply and the carrier liquid for supply from the toner tank and the carrier tank, respectively, to the mixer, or in order to supply the liquid developer from the mixer to the developing device, pumps and liquid sending pipes are provided in an apparatus main assembly. When abnormality occurs in these mixers, pumps, liquid sending pipes and the like, it becomes difficult to properly supply the liquid developer to the developing device. The user is required to periodically perform maintenance to the mixer, the pumps, the liquid sending pipes and the like. However, the toner tank and the carrier tank are disposed at positions where the user is easy to exchange the toner tank and the carrier tank, and the mixer and the positions are disposed correspondingly, and therefore, conventionally, piping of the liquid sending pipes becomes complicated, so that it was hard for the user to perform maintenance. Therefore, in the image forming apparatus using the liquid developer, an apparatus easy to perform the maintenance has been desired conventionally, but such an apparatus has not yet been proposed.

SUMMARY OF THE INVENTION

Problem to be Solved by the Invention

An object of the present invention is to improve a maintenance property in an image forming apparatus using a liquid developer.

Means for Solving the Problem

According to an aspect of the present invention, there is provided an image forming apparatus comprising: an apparatus main assembly; a drawer portion provided so as to be capable of being drawn out of the apparatus main assembly; an image forming portion, provided in the apparatus main assembly, for forming an image with a liquid developer containing toner and a carrier liquid; a supply container accommodating one of toner for supply and a carrier liquid for supply; and a unit provided between the image forming portion and the supply container in a feeding passage of the liquid developer, wherein the supply container and the unit are provided in the drawer portion.

EMBODIMENTS FOR CARRYING OUT THE INVENTION

[Image Forming Apparatus]

Figure 1:
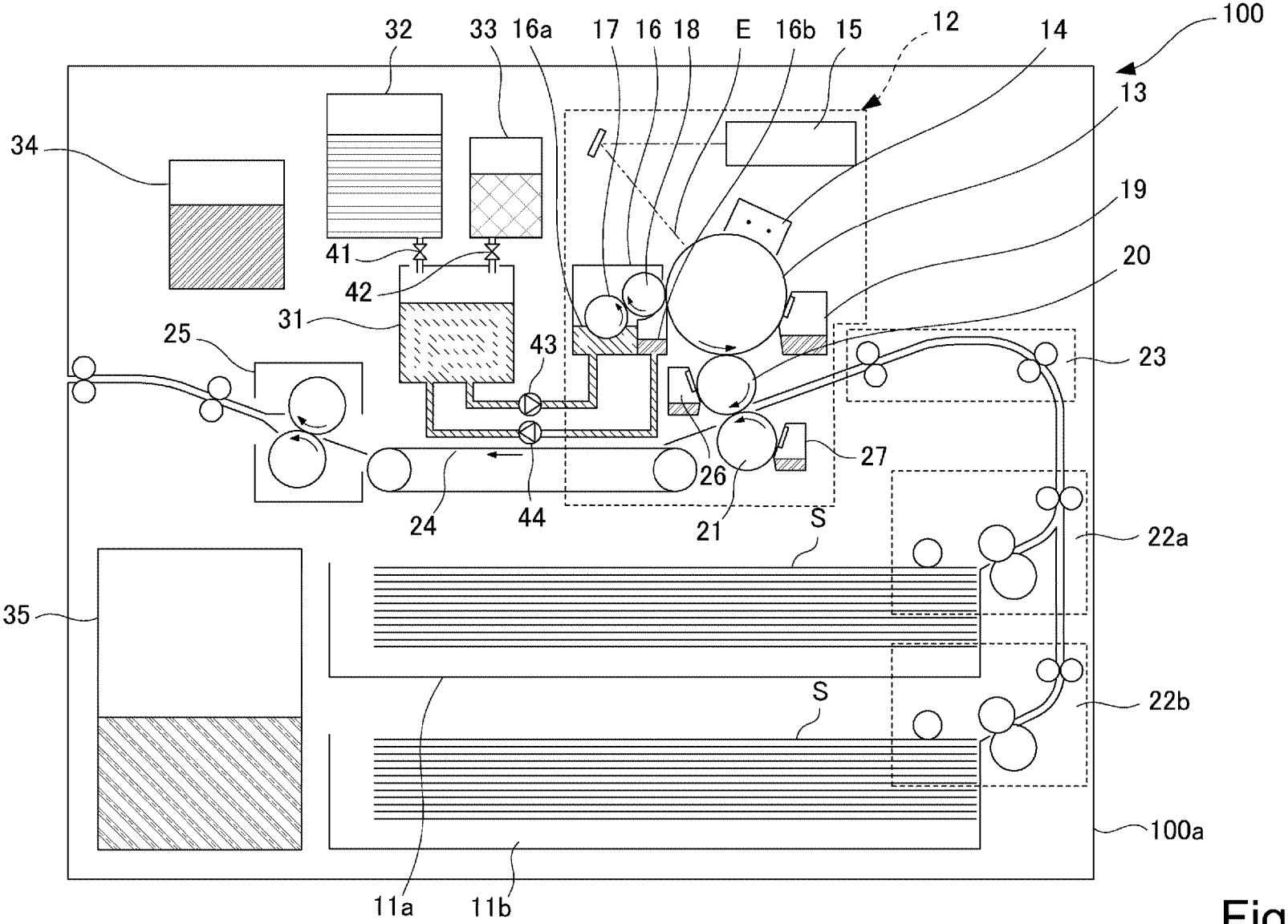
FIG. 1 is a schematic sectional view showing an image forming apparatus of this embodiment.

First, a general structure of an image forming apparatus in this embodiment will be described using FIG. 1 and FIG. 2. An image forming apparatus 100 shown in FIG. 1 is a digital printer of an electrophotographic type in which an image is formed on a recording material S (a sheet, a sheet material such as an OHP sheet and so on). The image forming apparatus 100 is operated on the basis of an image signal, and a toner image formed by an image forming portion 12 is transferred onto the recording material S successively fed from each of cassettes 11*a*, 11*b* and then is fixed on the recording material S, so that the image is obtained. The image signal is sent from an external terminal such as an unshown scanner or an unshown personal computer to the image forming apparatus 100. An operation of the image forming apparatus 100 is controlled by an unshown controller.

The image forming portion 12 provided in an apparatus main assembly 100*a* (in an apparatus main assembly) includes a photosensitive drum 13 as a photosensitive image bearing member, a charger 14, a laser exposure device 15, a developing device 16 and a drum cleaner 19. A surface of the photosensitive drum 13 electrically charged by the charger 14 is irradiated with laser light E from the laser exposure device 15 depending on the first signal, so that an electrostatic latent image is formed on the photosensitive drum 13. This electrostatic latent image is developed as a toner image by the developing device 16. In the case of this embodiment, in the developing device 16 as a developing device (apparatus), a liquid developer D in which particulate toner is dispersed in a carrier liquid is accommodated, and development is effected using this liquid developer. As the liquid developer used in the image forming apparatus 100 of this embodiment, a conventionally used liquid developer may also be used.

The liquid developer is formed by mixing and dispersing toner in a carrier liquid in a predetermined ratio (for example, 5±0.5%) in a mixer 31 as a mixing device, and then is supplied to the developing device 16. Then, the toner is consumed with the development and a deteriorated carrier liquid is discharged, and therefore, the toner and the carrier liquid are supplied (replenished) to the mixer 31. The carrier liquid for supply is accommodated in a carrier tank 32 as a supply container (carrier container), and the toner T for supply is accommodated in a toner tank 33 as a supply container (toner container). Then, depending on the toner content or a liquid amount of the liquid developer in the mixer 31, the toner for supply is supplied from the toner tank 33 to the mixer 31. In the mixer 31, a stirring member is provided, and the mixer 31 stirs and mixes the supplied carrier liquid and the toner by the stirring member, so that the toner is dispersed in the carrier liquid. Incidentally, the toner for supply is a liquid developer in which the toner content (for example 50±1%) which is higher than the above-described predetermined ratio.

The liquid developer supplied from the mixer 31 to the developing device 16 is coated (supplied) on a developing roller 18 by a coating roller 17 in a collecting section 16*a* of the developing device 16, and is used for development. The developing roller 18 carries and feeds the liquid developer D on a surface thereof, and develops with the liquid developer the electrostatic latent image formed on the photosensitive drum 13. The liquid developer remaining on the developing roller 18 after the development is collected in a collecting section 16*b* of the developing device 16. Here, each of coating of the liquid developer from the coating roller 17 onto the developing roller 18 and the development of the electrostatic latent image on the photosensitive drum 13 by the developing roller 18 is made using an electric field.

The toner image formed on the photosensitive drum 13 is primary-transferred onto an intermediary transfer roller 20 using the electric field, and then is fed to a nip (secondary transfer portion) formed by the intermediary transfer roller 20 and a transfer roller 21. The liquid developer remaining on the photosensitive drum 13 after the primary transfer of the toner image onto the intermediary transfer roller 20 is collected by the drum cleaner 19.

The recording material S accommodated in each of the cassettes 11*a*, 11*b* is fed toward a registration feeding portion 23 by an associated feeding portion 22*a* or 22*b* constituted by feeding rollers. The registration feeding portion 23 feeds the recording material S to the nip between the intermediary transfer roller 20 and the transfer roller 21 by being timed to the toner image transferred on the intermediary transfer roller 20.

In the nip between the intermediary transfer roller 20 and the transfer roller 21, the toner image is secondary-transferred onto the recording material S passing through the nip. The recording material S on which the toner image is transferred is fed to a fixing device 25 by a feeding belt 24, so that the toner image transferred on the recording material S is fixed. The recording material S on which the toner image is fixed is discharged to an outside of the image forming apparatus, so that an image forming step is completed. In this embodiment, the fixing device 25 employs a heat-fixing type. In the case of this type, the fixing device 25 includes two rollers which sandwiches the recording material S from above and below and which are pressed against each other, and these two rollers are maintained at a surface temperature of about 200° C. By this, the surface of the recording material S fed at a predetermined process speed (for example, 600 mm/s) is maintained at a temperature of 60° C. or more which is a glass transition point (temperature) at which the toner is melted. The toner is melted, whereby the toner is fixed on the recording material S.

The intermediary transfer roller 20 and the transfer roller 21 are provided with an intermediary transfer roller cleaner 26 and a transfer roller cleaner 27, respectively. The intermediary transfer roller cleaner 26 collects, from the intermediary transfer roller 20, the liquid developer remaining on the intermediary transfer roller 20 after the secondary transfer. The transfer roller cleaner 27 collects, from the transfer roller 21, the liquid developer remaining on the transfer roller 21 after the secondary transfer.

Next, the feeding of the liquid developer in the image forming apparatus 100 will be described. The liquid sending pipes (pipes, tubes and the like) for connecting the carrier tank 32 with the mixer 31 and for connecting the toner tank 33 with the mixer 31 is provided with a carrier supply pump 41 as a pump for a carrier mixer and a toner supply pump 42 as a pump for a toner mixer, respectively. The carrier supply pump 41 and the toner supply pump 42 adjust a supply amount of the carrier liquid for supply to the mixer 31 and a supply amount of the toner for supply to the mixer 31, respectively. In the mixer content (concentration) adjustment of the liquid developer is performed in order to adjust the toner content of the liquid developer detected by an unshown toner content sensor, to a predetermined ratio (for example, 5±0.5%). For example, in the case where the toner content is higher than the predetermined ratio, the carrier liquid for supply is supplied from the carrier tank 32 to the mixer 31, and in the case where the toner content is lower than the predetermined ratio, the toner for supply is supplied from the toner tank 33 to the mixer 31. By this, the toner content of the liquid developer in the mixer 31 is adjusted to the predetermined ratio.

From the mixer 31, the liquid developer necessary for the development is supplied to the developing device 16 by a developer supplying pump 43. The developing device 16 is provided with an unshown developer amount detecting device, and the developer amount detecting device detects an amount of the liquid developer in the developing device 16. Supply of the liquid developer to the developing device 16 is carried out so that a detection value of the developer amount detecting device is not less than a predetermined value (for example 200 ml). Then, the liquid developer which remains on the developing roller 18 after the development and which is collected into a collecting section 16*b* of the developing device 16 is returned to the mixer 31 by a circulating pump 44.

As described above, the liquid developer collected by the drum cleaner 19, the intermediary transfer roller cleaner 26 and the transfer roller cleaner 27 is fed to the separation and extraction device 34 by unshown pumps. The separation and extraction device 34 separates the liquid developer into the toner T and the carrier liquid C by an electrolytic parting system, and makes the carrier liquid re-usable.

As described above, in the case of this embodiment, the carrier liquid for supply is supplied from the carrier tank 32, and the toner for supply is supplied from the toner tank 33. For that reason, the carrier tank 32 and toner tank 33 empty in some instances, and in that case, a user is required to exchange the empty carrier tank 32 with a carrier tank 32 filled with the carrier liquid for supply and to exchange the empty toner tank 33 with a toner tank 33 filled with the toner for supply.

Figure 2:
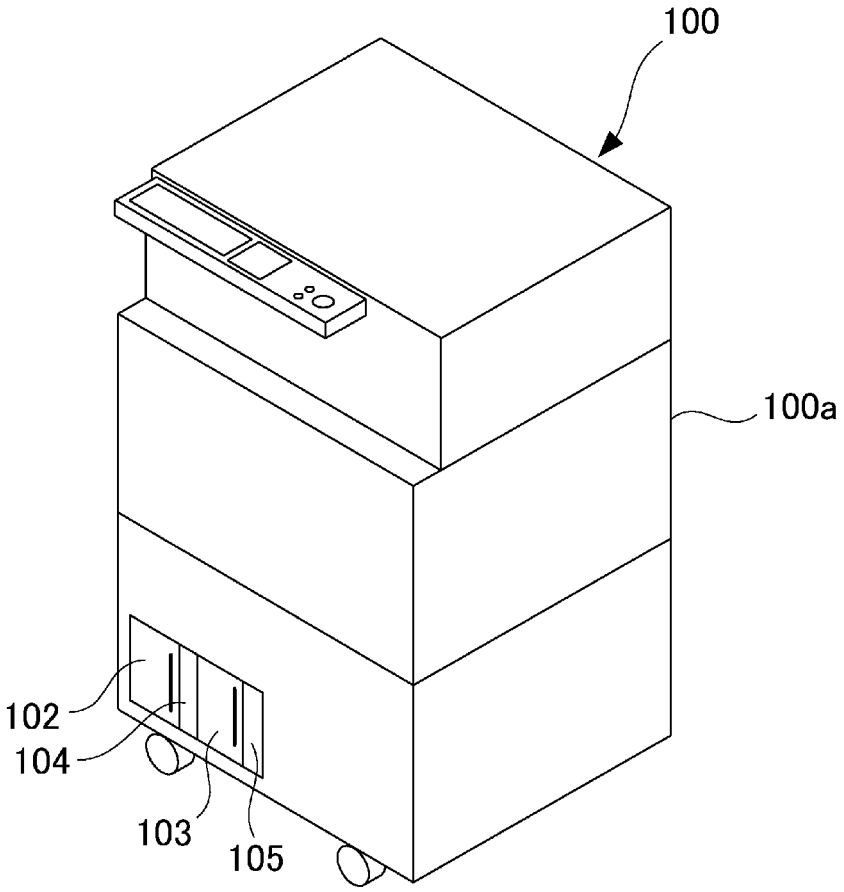
FIG. 2 is a perspective view of an outer appearance of the image forming apparatus.

Therefore, as shown in FIG. 2, the image forming apparatus 100 of this embodiment is provided with two (first and second) openable doors on the apparatus main assembly 100*a*. The first door is a toner unit door 103 by which the user has access to the toner tank 33 and a toner supply unit 101 (described later with reference to FIG. 3). The second door is a carrier unit door 102 by which the user has access to the carrier tank 32 and a carrier supply unit 201 (described later with reference to FIG. 3). In the case of this embodiment, the user needs to open the toner unit door 101 when the user exchanges the toner tank 33 or performs maintenance of the toner supply unit 101. Further, the user needs to open the carrier unit door 102 when the user exchanges the carrier tank 32 or performs maintenance of the carrier supply unit 201. For that purpose, in this embodiment, a constitution in which the toner tank 33 and the toner supply unit 101 can be drawn out integrally with each other and in which the carrier tank 32 and the carrier supply unit 201 can be drawn out integrally with each other is employed.

However, in this embodiment, in the case where the toner unit door 103 or the carrier unit door 102 is only opened, the user can only draw out and exchange the toner tank 33 or the carrier tank 32. That is, when the user only opens the toner unit door 103 or the carrier unit door 102, the user cannot draw out the toner supply unit 101 or the carrier supply unit 201 from the apparatus main assembly 100*a* and thus cannot perform the maintenance of the toner supply unit 101 or the carrier supply unit 201. As specifically described later, in order that the user draws out the toner supply unit 101 from the apparatus main assembly 100*a* so as to be capable of performing the maintenance thereof, the user needs to remove a toner door cover 105 provided adjacent to the toner unit door 103 for movement toward and away from the apparatus main assembly 100*a*. Similarly, in order that the user draws out the carrier supply unit 201 from the apparatus main assembly 100*a* so as to be capable of performing the maintenance thereof, the user needs to remove a carrier door cover 103 provided adjacent to the carrier unit door 102 for movement toward and away from the apparatus main assembly 100*a*. These toner door cover 105 and carrier door cover 104 are secured to the apparatus main assembly 100*a* with dedicated screws which are capable of being mounted to and dismounted from the apparatus main assembly 100*a* only by a dedicated tool for maintenance, for example. The toner door cover 105 and the carrier door cover 104 are capable of restricting (regulating) drawing (operation) of the toner supply unit 101 and the carrier supply unit 201, respectively, so that only the toner tank 33 or only the carrier tank 32 is drawn out of the apparatus main assembly 100*a* in a state in which the toner door cover 105 and the carrier door cover 104 are secured to the apparatus main assembly 100*a*. In the following, this will be described.

Figure 3:
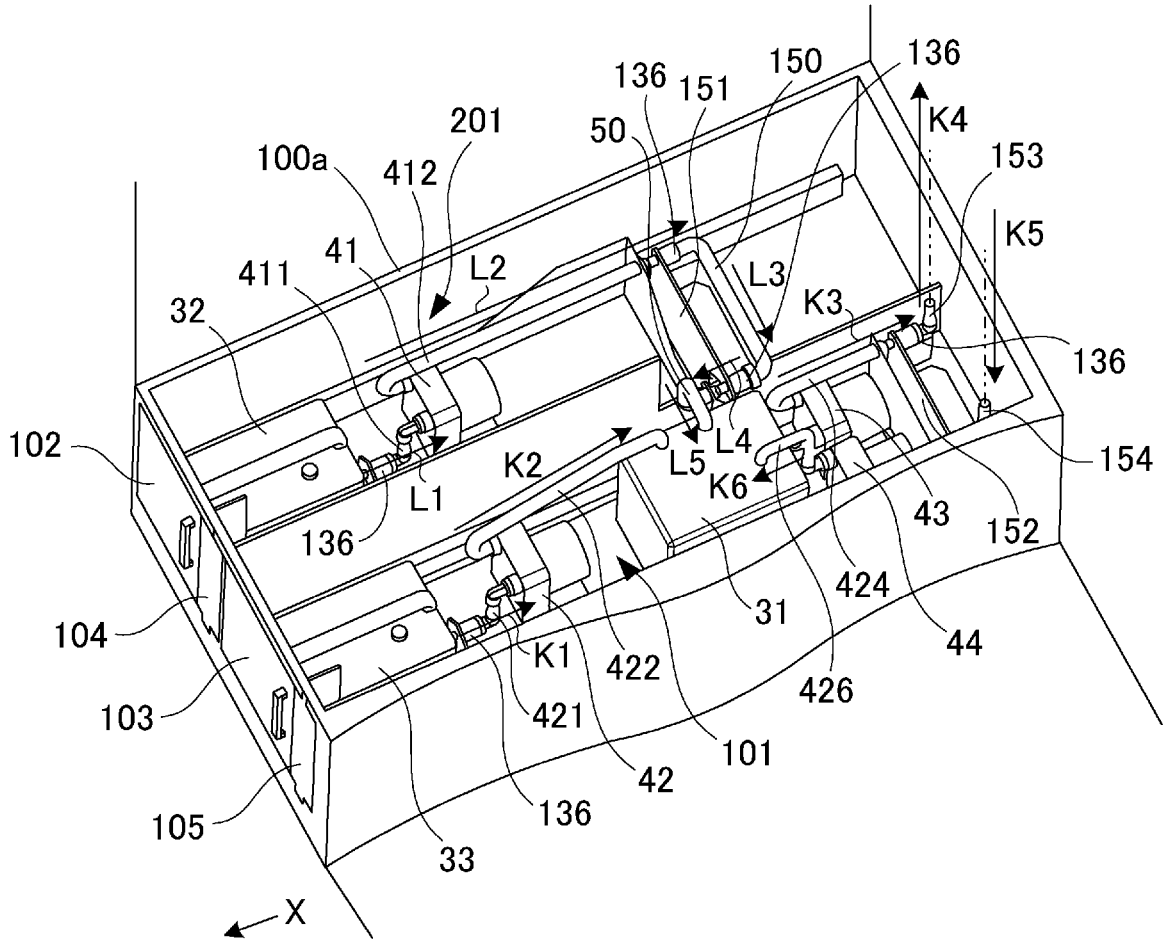
FIG. 3 is a perspective view showing units in this embodiment.

First, the toner supply unit 101 and the carrier supply unit 201 will be described being FIGS. 3 to 5 while making reference to FIG. 1. In this embodiment, as shown in FIG. 3, the toner supply unit 101 and the carrier supply unit 201 are provided in parallel to each other with respect to a direction crossing a drawing direction (arrow X direction). The toner supply unit 101 is disposed between the image forming portion 12 and the toner tank 33 in a liquid developer feeding passage and includes the toner supply pump 42, the mixer 31, the developer supply pump 43 and the circulation pump 44. The toner supply unit 101 is provided so as to be capable of being drawn out of the toner unit door 103. On the other hand, the carrier supply unit 201 includes the carrier supply pump 41 and is provided so as to be capable of being drawn out of the carrier unit door 102.

Incidentally, as the carrier supply pump 41, the toner supply pump 42 and the developer supply pump 43, for example, a volute pump or the like driven by a brushless DC motor is employed. These pumps may also be a gear pump, a piston pump or the like when the pump is capable of ensuring a necessary flow rate correspondingly to viscosity of the liquid developer.

Figure 4:
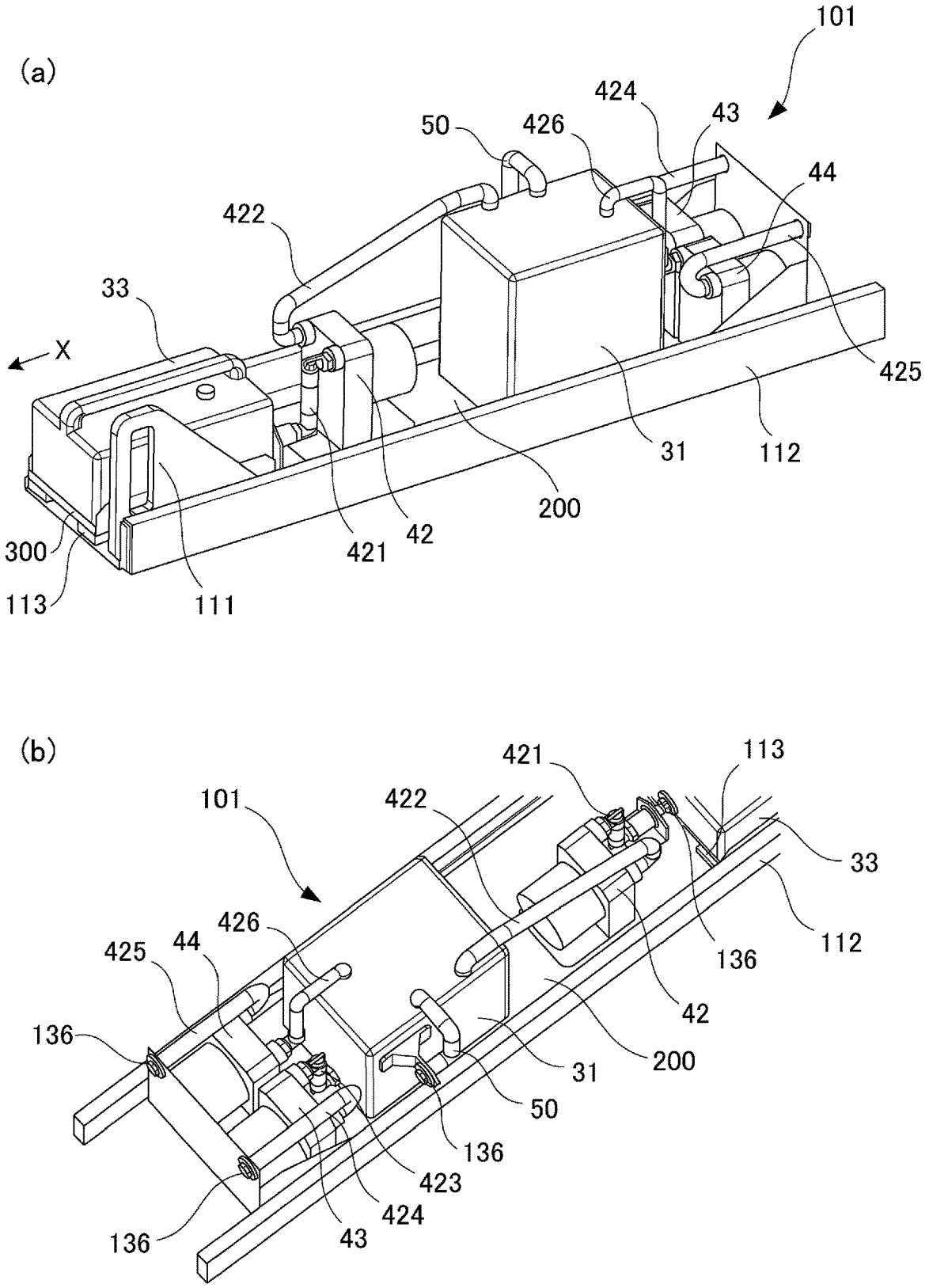
FIG. 4 includes views showing a toner tank and a toner supply unit, in which part (a) is a perspective view thereof as seen from a downstream side of a drawing direction, and part (b) is a partially perspective view thereof as seen from an upstream side of the drawing direction.

As shown in parts (a) and (b) of FIG. 4, the toner supply unit 101 includes liquid sending pipes 421, 422, 423 and 424 so that the toner is sent from the toner tank 33 to the developing device 16 through the mixer 31. Further, the toner supply unit 101 includes a liquid sending pipe 50 for sending the carrier liquid from the carrier tank 32 to the mixer 31 and includes liquid sending pipes 425 and 426 for sending, to the mixer 31, the liquid developer collected in the collecting section 16*b* (FIG. 1) of the developing device 16. Further, as shown in part (b) of FIG. 4, the toner tank 33, the toner supply pump 42, the mixer 31 and the developer supply pump 43 are held on a toner unit table 200 as a part of a drawer portion in the order from a downstream side (front side) of the toner supply unit 101 with respect to the drawing direction. The toner unit table 200 is provided with a rail member 112 extending in the drawing direction (arrow X direction in the figure), and by this rail member 112, the toner unit table 200 is supported on the apparatus main assembly 100*a* so as to be slidable (movable) in the drawing direction.

Further, the toner unit table 200 is provided with a handle 111 for drawing out the toner supply unit 101 toward the downstream side of the drawing direction. Further, the toner unit table 200 is provided with a toner tank table 300 as a part of the drawer portion for holding the toner tank 33 so as to be exchangeable. As specifically described later (FIG. 8 to part (b) of FIG. 9), the toner tank table 300 as a container holding portion and the toner unit table 200 as a unit holding portion are provided so as to be movable relative to each other.

Figure 5:
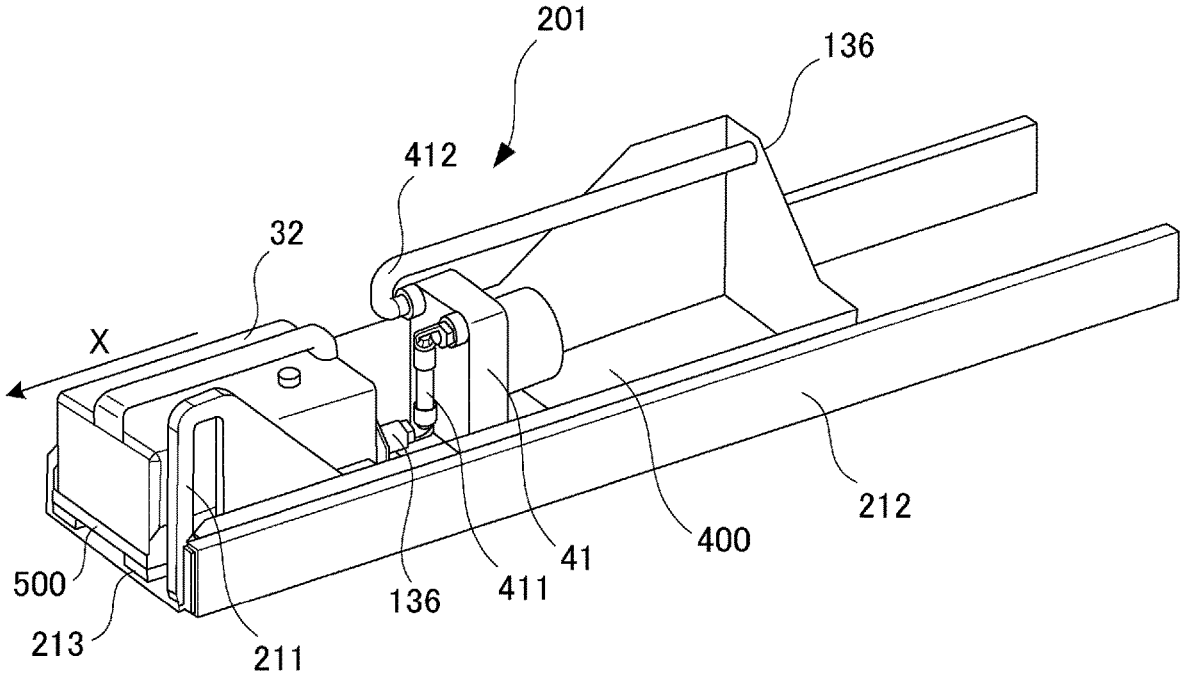
FIG. 5 is a perspective view showing a carrier tank and a carrier supply unit.

As shown in FIG. 5, the carrier supply unit 201 includes liquid sending pipes 411 and 412 as a piping portion for a container mixer for sending the carrier liquid from the carrier tank 32 to the mixer 31. Further, the carrier tank 32 and the carrier supply pump 41 and held on a carrier unit table 400 as a part of a drawer portion in the order from a downstream side of the carrier supply unit 201 with respect to the drawing direction. The carrier unit table 400 is provided with a rail member 212 extending in the drawing direction (arrow X direction in the figure), and by this rail member 212, the carrier unit table 400 is supported on the apparatus main assembly 100*a* so as to be slidable (movable) in the drawing direction.

Further, the carrier unit table 400 is provided with a handle 211 for drawing out the carrier supply unit 201 toward the downstream side of the drawing direction. Further, the carrier unit table 400 is provided with a carrier tank table 500 as a part of the drawer portion for holding the carrier tank 32 so as to be exchangeable. As specifically described later in (part (a) of FIG. 10 and part (b) of FIG. 10), the carrier tank table 500 as a container holding portion and the carrier unit table 400 as a unit holding portion are provided so as to be movable relative to each other.

On the other hand, to the apparatus main assembly 100*a*, a holding plate 152 is fixed on a side (rear side) upstream of the toner supply unit 101 with respect to the drawing direction. The holding plate 152 holds a liquid sending pipe 153 connected to the developing device 16 at one end thereof and holds a liquid sending pipe 154 connected to the collecting section 16*b* of the developing device 16 at the other end thereof. The liquid sending pipe 153 is provided for movement toward and away from the liquid sending pipe 424 connected to the toner supply pump 42 at one end thereof by a joint portion 136, and the liquid sending pipe 154 is provided for movement toward and away from the liquid sending pipe 425 connected to the circulation pump 44 at one end thereof by a joint portion 136. Further, to the apparatus main assembly 100*a*, a holding plate 151 is fixed on a side upstream of the carrier supply unit 201 with respect to the drawing direction. The holding plate 151 holds the liquid sending pipe 150. One end of the liquid sending pipe 150 is provided for movement toward and away from the liquid sending pipe 412 by a joint portion 136, and the other end of the liquid sending pipe 150 is provided for movement toward and away from the liquid sending pipe 50 by a joint portion 136. By this constitution, in the case of this embodiment, the toner supply unit 101 is disconnected from the liquid sending pipes 153 and 154 held by the holding plate 152, during drawing thereof from the apparatus main assembly 100*a*. On the other hand, the carrier supply unit 201 is disconnected from the liquid sending pipe 150 held by the holding plate 151, during the drawing thereof from the apparatus main assembly 100*a*.

Returning to FIG. 3, the toner in the toner tank 33 is supplied to the mixer 31 (arrows K1 and K2) through the liquid sending pipes 421 and 422 as the piping portion for the toner mixer with an operation of the toner supply pump 42. The carrier liquid in the carrier tank 32 is supplied to the mixer 31 (arrows L1, L2, L3, L4 and L5) through the liquid sending pipes 411, 412, 150 and 50 with an operation of the carrier supply pump 41. The mixer 31 mixes the toner flowing therein from the liquid sending pipe 422 and the carrier liquid flowing therein from the liquid sending pipe 50 and thus forms the liquid developer, and the formed liquid developer is supplied to the developing device 16 through the liquid sending pipes 423 and 424 and then through the liquid sending pipe 153 (arrows K3 and K4). Further, the liquid developer which becomes excessive in the developing device 16 is returned to the mixer 31 through the liquid sending pipes 154, 425 and 426 (arrows K5 and K6).

Further, the toner tank 33 is provided for movement toward and away from the toner supply unit 101. That is, as shown in part (a) of FIG. 4, the toner tank 33 is provided for movement toward and away from the liquid sending pipe 421, connected at one end thereof to the toner supply pump 42, by the joint portion 136. By this, the toner tank 33 is dismountable from the liquid sending pipe 421 by being disconnected from the liquid sending pipe 421 during the exchange thereof. On the other hand, the carrier tank 32 is provided for movement toward and away from the carrier supply unit 201. That is, as shown in FIG. 5, the carrier tank 32 is provided for movement toward and away from the liquid sending pipe 411, connected at one end thereof to the carrier supply pump 41, by the joint portion 136. By this, the carrier tank 32 is dismountable from the liquid sending pipe 411 by being disconnected from the liquid sending pipe 411 during the exchange thereof.

Figure 6:
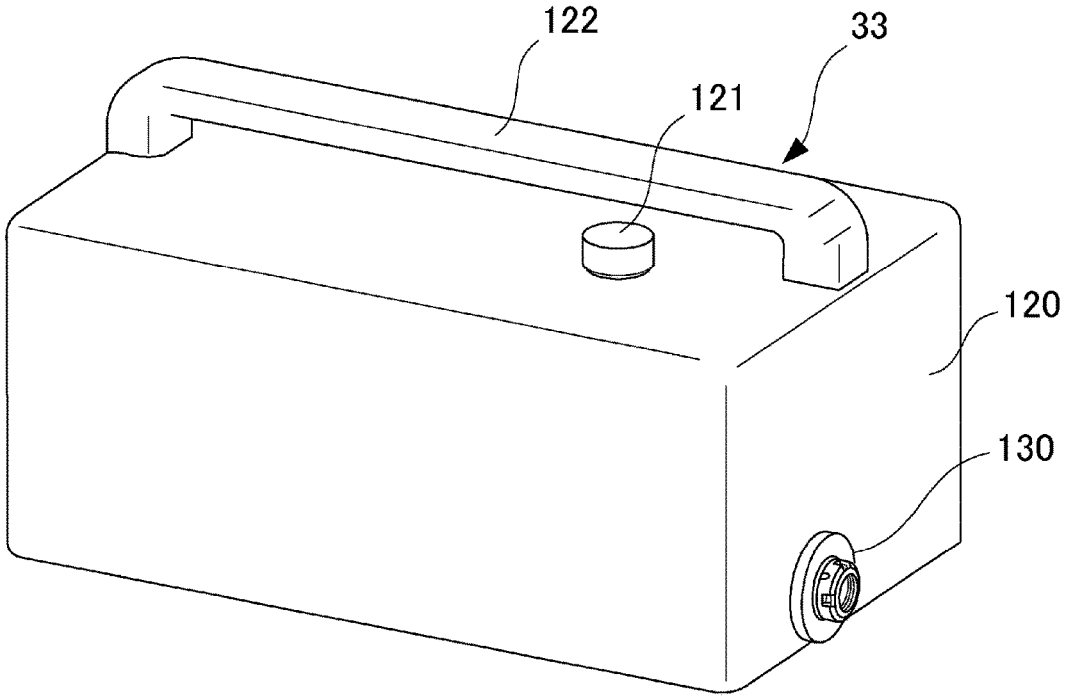
FIG. 6 is a perspective view, of an outer appearance, showing the toner tank.

Here, the joint portion 136 will be described using FIG. 6 and parts (a) and (b) of FIG. 7. In this embodiment, the joint portion 136 capable of connecting and disconnecting the toner tank 33 and the liquid sending pipe 421 as an example, but other joint portions provided at positions other than the position between the toner tank 33 and the liquid sending pipe 421 may also be similarly constituted. FIG. 6 shows the toner tank 33. As shown in FIG. 6, the toner tank 33 includes an accommodating container 120 capable of accommodating the toner, a gripping portion 122 which is mounted on the accommodating container 120 and which is capable of being gripped by the user, and a cap 121 mounted on the accommodating container 120. The cap 121 is used for establishing air communication with an inside of the toner tank 33 by being dismounted by the user so that the liquid developer in the toner tank 33 is capable of being sent with an operation of the toner supply pump 42. Further, the accommodating container 120 is provided with a receiving portion 130 which is a part of the joint portion 136. Incidentally, the carrier tank 32 may also have the same constitution as the toner tank 33.

Figure 7:
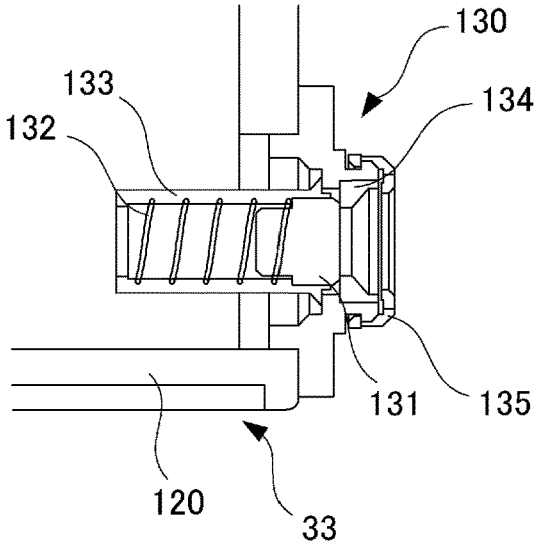
FIG. 7 includes views for illustrating a joint portion, in which part (a) shows a disconnection state, and part (b) shows a connection state.
Figure 7:
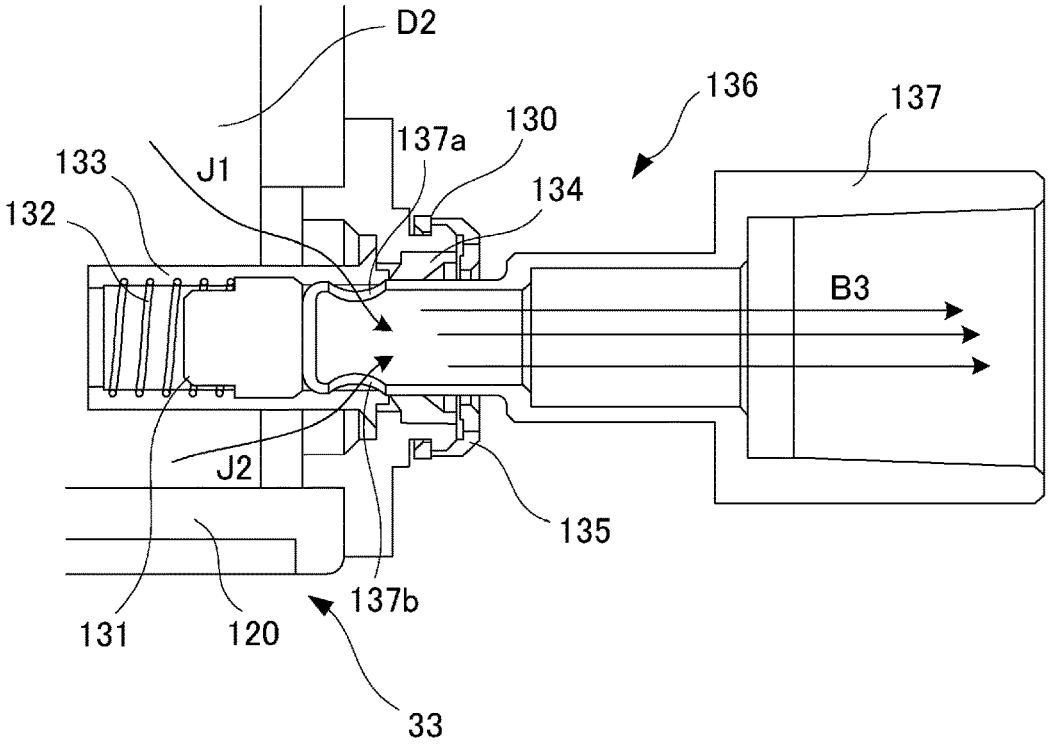

As shown in part (a) of FIG. 7, the receiving portion 130 includes a (cylindrical) joint cylinder 133 extending from a side surface toward an inside of the accommodating container 120 and includes a piston coupler 131 supported inside the joint cylinder 133 so as to be capable of being reciprocated. The piston coupler 131 is urged from the inside toward an outside the accommodating container 120 by a joint spring 132. Further, the receiving portion 130 includes a joint seal 134 molded with a silicone rubber or the like for sealing the joint cylinder 133 and includes a joint cover 135 covering the joint seal 134 from an outside of the joint seal 134. In the case where the toner tank 33 and the liquid sending pipe 421 are in a disconnection (dismounting) state, the piston coupler 131 is abutted against the joint seal 134 by being urged by the joint spring 132, so that the joint seal 134 seals the receiving portion 130 so as to prevent the toner from leaking out to the outside of the accommodating container 120.

As shown in part (b) of FIG. 7, in a connection (mounting) state between the toner tank 33 and the liquid sending pipe 421 through the joint portion 136, a free end of a coupler 137 provided at an end portion of the liquid sending pipe 421 enters the inside of the joint cylinder 133. At the free end of the coupler 137, suction openings 137*a* and 137*b* are formed, and through these suction openings 137*a* and 137*b*, the toner in the accommodating container 120 enters the inside of the coupler 137 along paths indicated by arrows J1 and J2 in the figure. Then, the toner entered the inside of the coupler 137 flows along an arrow B3 and passes through the liquid sending pipe 421 and then reaches the toner supply pump 42 (part (a) of FIG. 4).

Figure 8:
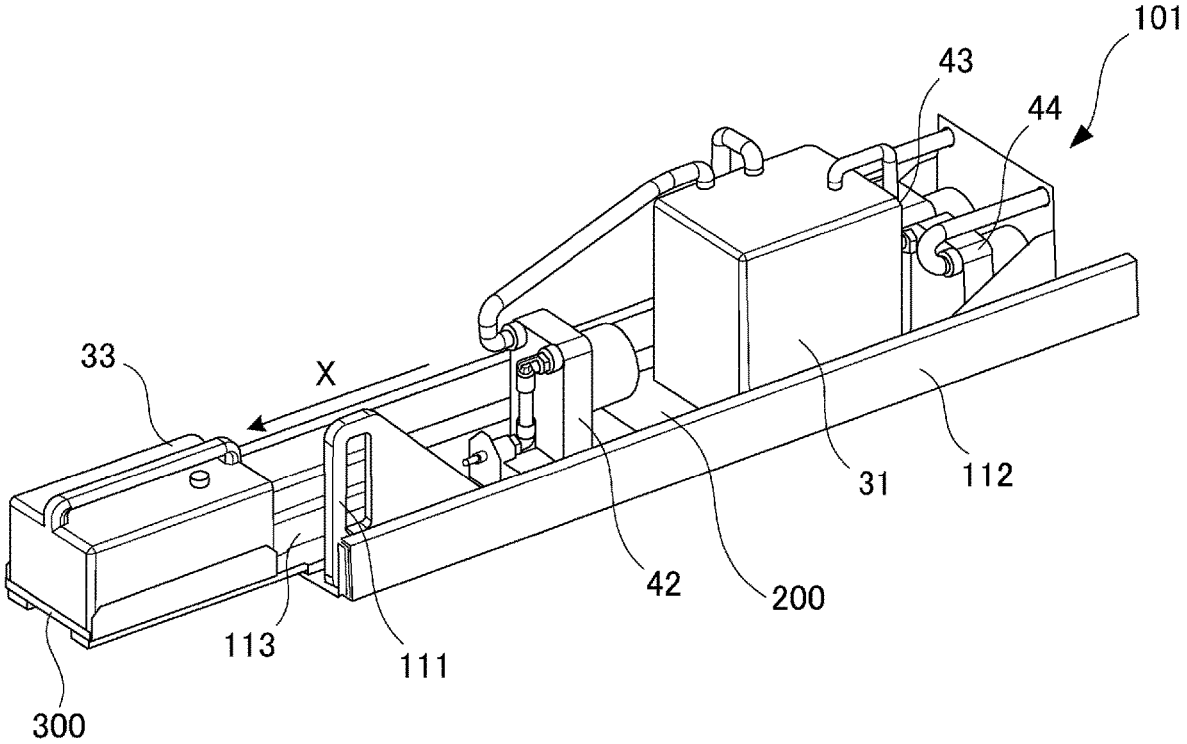
FIG. 8 is a perspective view for illustrating a drawing mechanism.

Next, drawing of the toner tank 33 and the toner supply unit 101 will be described using FIG. 8 and parts (a) and (b) of FIG. 9. As described above, the toner unit table 200 is supported on the apparatus main assembly 100*a* by the rail member 112 extending in the drawing direction so that the toner unit table 200 is slidable (movable) in the drawing direction. Further, as shown in FIG. 8, the toner supply unit 101 is fixed on the toner unit table 200, and on the toner unit table 200, the toner tank table 300 capable of holding the toner tank 33 is supported. The toner tank table 300 is provided with a rail member 113 extending in the drawing direction, and by this rail member 113, the toner tank table 300 is supported by the toner unit table 200 so as to be slidable (movable) relative to the toner unit table 200.

Figure 9:
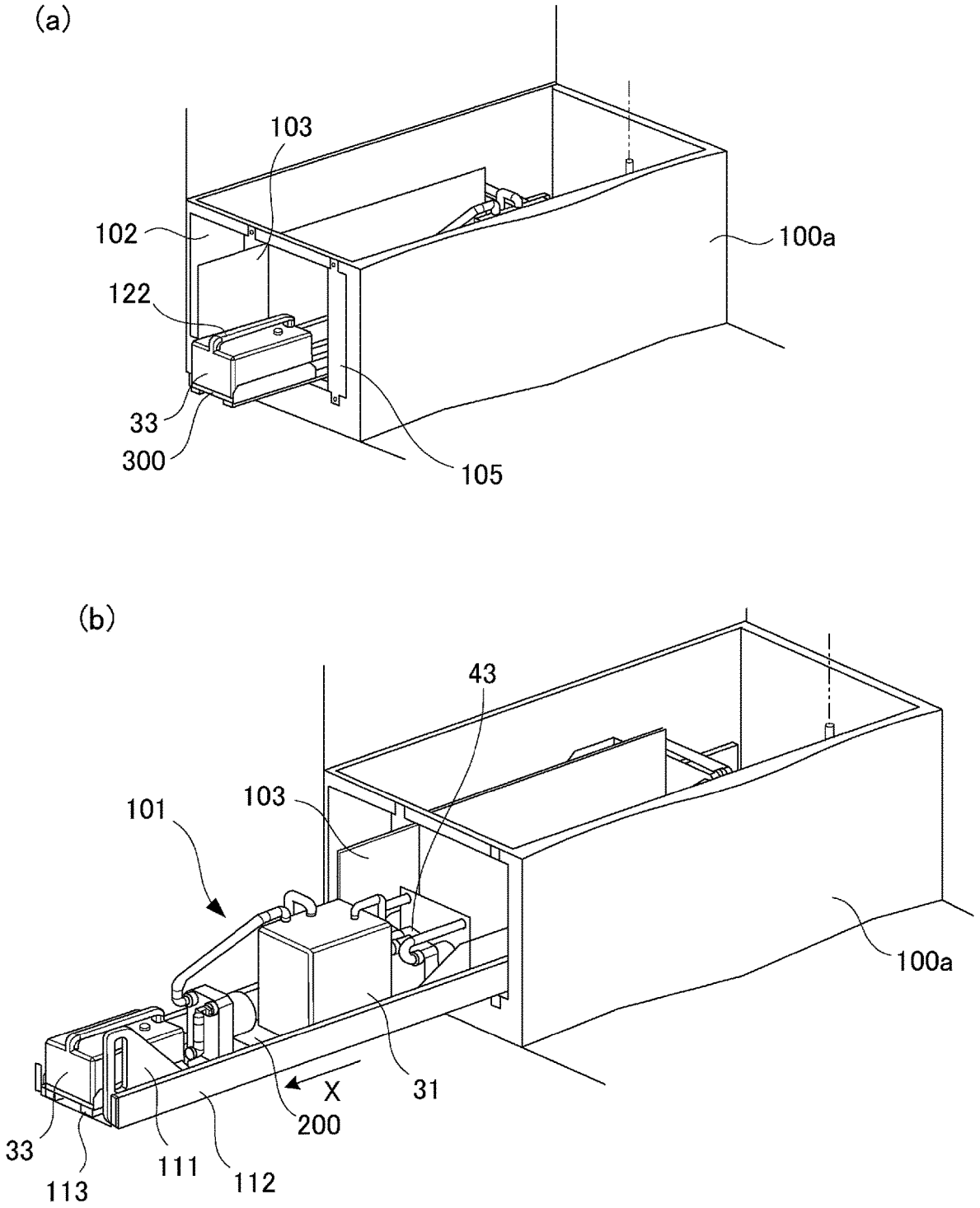
FIG. 9 includes views for illustrating the drawing mechanism, in which part (a) shows a state in which the toner tank is drawn out, and part (b) shows a state in which the toner supply unit is drawn out.

As shown in part (a) of FIG. 9, the user opens the toner unit door 103 and moves the toner tank 33 in the drawing direction while holding the gripping portion 122 of the toner tank 33, whereby the user is capable of drawing out the toner tank 33 from the apparatus main assembly 100*a*. At this time, in the case where the user does not remove the toner door cover 105 in advance, the user can draw out the toner tank 33 from the apparatus main assembly 100*a*, while the user cannot draw out the toner supply unit 101. This is because in the case where the toner door cover 105 as a restricting member is not removed, during the drawing of the toner tank table 300, the handle 111 abuts against the toner door cover 105 and thus movement of the toner unit table 200 in the drawing direction is restricted. By restriction of the movement of the toner unit table 200 in the drawing direction, the toner tank table 300 starts to move relative to the toner unit table 200, with the result that only the toner tank 33 is drawn out of the apparatus main assembly 100*a*. Thereafter, the user is capable of exchanging the toner tank 33. Thus, in a state in which the toner door cover 105 is mounted, the handle 111 is disposed at a position opposing the toner door cover 105 with respect to the drawing direction so that the handle 111 abuts against the toner door cover 105 with a drawing operation.

As shown in part (b) of FIG. 9, in a state in which the toner door cover 105 is removed, the user holds the handle 111 and moves the toner supply unit 101 in the drawing direction, so that the user is capable of drawing out the toner tank 33 and the toner supply unit 101 integrally with each other. In this case, the user is capable of performing maintenance of the toner supply unit 101, specifically maintenance of the toner supply pump 42, the mixer 31, the developer supply pump 43, the circulating pump 44, the liquid sending pipes 421 to 426, and the liquid sending pipe 50 (parts (a) and (b) of FIG. 4).

Next, drawing of the carrier tank 32 and the carrier supply unit 201 will be described using parts (a) of FIG. 10 and (b) of FIG. 10 while making reference to FIG. 5. As described above, the carrier unit table 400 is supported on the apparatus main assembly 100*a* by the rail member 212 extending in the drawing direction so that the toner unit table 200 is slidable (movable) in the drawing direction. Further, as shown in FIG. 5, the carrier supply unit 201 is fixed on the carrier unit table 400, and on the carrier unit table 400, the carrier tank table 500 capable of holding the carrier tank 32 is supported. The carrier tank table 500 is provided with a rail member 213 extending in the drawing direction, and by this rail member 213, the carrier tank table 500 is supported by the carrier unit table 400 so as to be slidable (movable) relative to the carrier unit table 400.

Figure 10:
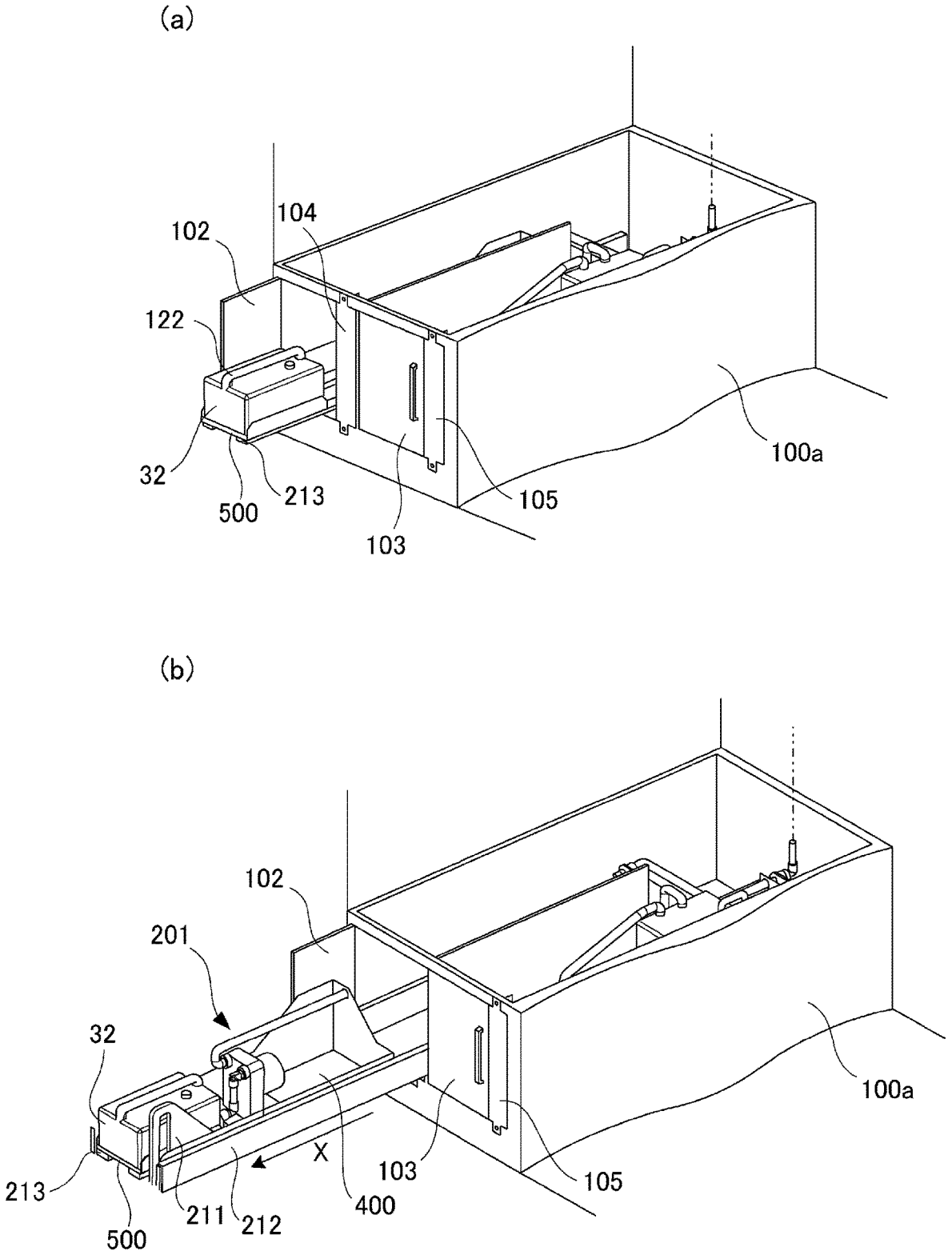
FIG. 10 includes views for illustrating a drawing mechanism, in which part (a) shows a state in which the carrier tank is drawn out, and part (b) shows a state in which the carrier supply unit is drawn out.

As shown in part (a) of FIG. 10, the user opens the carrier unit door 102 and moves the carrier tank 32 in the drawing direction while holding the gripping portion 122 of the carrier tank 32, whereby the user is capable of drawing out the carrier tank 32 from the apparatus main assembly 100*a*. At this time, in the case where the user does not remove the carrier door cover 104 in advance, the user can draw out the carrier tank 32 from the apparatus main assembly 100*a*, while the user cannot draw out the carrier supply unit 201. This is because in the case where the carrier door cover 104 as a restricting member is not removed, the handle 211 abuts against the carrier door cover 104 and thus movement of the carrier unit table 400 in the drawing direction is restricted. By restriction of the movement of the carrier unit table 400 in the drawing direction, the carrier tank table 500 starts to move relative to the carrier unit table 400, with the result that only the carrier tank 32 is drawn out of the apparatus main assembly 100*a*. Thereafter, the user is capable of exchanging the carrier tank 32. Thus, in a state in which the carrier door cover 104 is mounted, the handle 211 is disposed at a position opposing the carrier door cover 104 with respect to the drawing direction so that the handle 211 abuts against the carrier door cover 104 with a drawing operation.

As shown in part (b) of FIG. 10, in a state in which the carrier door cover 104 is removed, the user holds the handle 211 and moves the carrier supply unit 201 in the drawing direction, so that the user is capable of drawing out the carrier tank 32 and the carrier supply unit 201 integrally with each other. Thereafter, the user is capable of performing maintenance of the carrier supply unit 201, specifically maintenance of the carrier supply pump 41 and the liquid sending pipes 411, and 412 (FIG. 5).

As described above, in this embodiment, a combination of the toner tank 33 and the toner supply unit 101 and a combination of the carrier tank 32 and the carrier supply unit 201 are provided on the toner unit table 200 and the carrier unit table 400, respectively, which are arranged in parallel and which are capable of being drawn out of the apparatus main assembly 100*a*. Thus, the user is capable of integrally drawing out the toner tank 33 and the toner supply unit 101 from the apparatus main assembly 100*a* and is capable of integrally drawing out the carrier tank 32 and the carrier supply unit 201 from the apparatus main assembly 100*a*, so that the maintenance thereof becomes easy.

Further, as described above, in the case of this embodiment, the toner tank 33 and the carrier tank 32 which are needed to be exchanged timely are constituted so that a general user has access thereto and is capable of exchanging the toner tank 33 and the carrier tank 32. However, at the time, it is preferable that only an expert such as a service person is caused to have access to the toner supply unit 101 and the carrier supply unit 201 which need expertise, without causing the general user to have access to the toner supply unit 101 and the carrier supply unit 201 to the extent possible. Therefore, in this embodiment, the general user was caused to draw out the toner tank 33 and the carrier tank 32 was caused to be capable of exchanging these tanks while leaving the toner supply unit 101 and the carrier supply unit 201 in the apparatus main assembly 100*a*. On the other hand, the expert was caused to be capable of performing the maintenance of the toner supply unit 101 and the carrier supply unit 201 by removing the toner door cover 105 and the carrier door cover 104 and then by drawing out the toner supply unit 101 and the carrier supply unit 201 from the apparatus main assembly 100*a*. Thus, according to this embodiment, it is possible to compatibly realize ensuring of ease of exchange of the toner tank 33 and the carrier tank 32 and access limitation to the toner supply unit 101 and the carrier supply unit 201 which require maintenance, by a simple constitution.

OTHER EMBODIMENTS

In the above-described embodiment, the constitution in which the toner for supply is supplied from the toner tank 33 to the mixer 31 was described as an example (part (a) of FIG. 4), but the present invention is not limited thereto. For example, a constitution in which a buffer tank as a toner storing portion for temporarily storing the toner is provided between the toner tank 33 and the mixer 31 in a feeding passage of the liquid developer and in which the toner for supply is supplied from the toner tank 33 to the buffer tank may also be employed. The case where the toner supply unit includes the buffer tank will be shown in FIG. 11. In this case, constituent elements which are the same as those in the above-described embodiment are represented by the same reference numerals or symbols.

Figure 11:
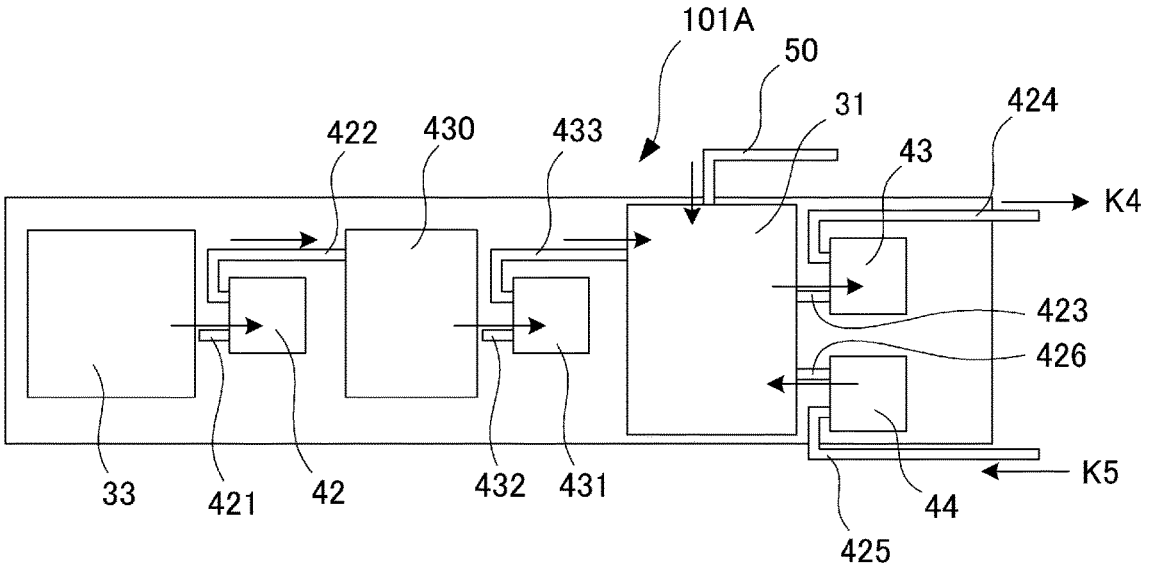
FIG. 11 is a schematic view showing a toner supply unit including a buffer tank.

As shown in FIG. 11, to a buffer tank 430, the toner for supply is supplied from the toner tank 33 through the liquid sending pipes 421 and 422 as a piping portion for the toner storing portion by the toner supply pump 42. Then, from the buffer tank 430, the toner is sent to the mixer 31 through liquid sending pipes 432 and 433 by a buffer pump 431. That is, a toner supply unit 101A includes the buffer tank 430, the buffer portion 431 and the liquid sending pipes 432 and 433, in addition to the above-described members. When such a buffer tank 430 is provided, all the toner in the toner tank 33 can be sent to the buffer tank 430 in advance. Then, the user uses up the toner in the toner tank 33 without waste and thereafter is capable of exchanging the toner tank 33 with time to spare. Further, even when the toner tank 33 empties and is not exchanged immediately, the toner in the buffer tank 430 is supplied to the mixer 31 for some time, so that image formation can be continued. Even in the case of such a constitution, the above-described embodiment is applicable.

Further, in the above-described embodiment, the constitution in which the carrier liquid for supply is supplied from the carrier tank 32 to the mixer 31 was described as an example (FIG. 3), but the present invention is not limited thereto. For example, a constitution in which a buffer tank as a carrier storing portion for temporarily storing the carrier liquid is provided between the carrier tank 32 and the mixer 31 in a feeding passage of the liquid developer may also be employed. To the carrier storing portion, for example, the carrier liquid for supply is supplied from the carrier tank 32 and the carrier liquid separated by the separation and extraction device 34 (FIG. 1) is supplied. The case where the carrier supply unit includes the carrier storing portion will be shown in FIG. 12. In this case, constituent elements which are the same as those in the above-described embodiment are represented by the same reference numerals or symbols.

Figure 12:
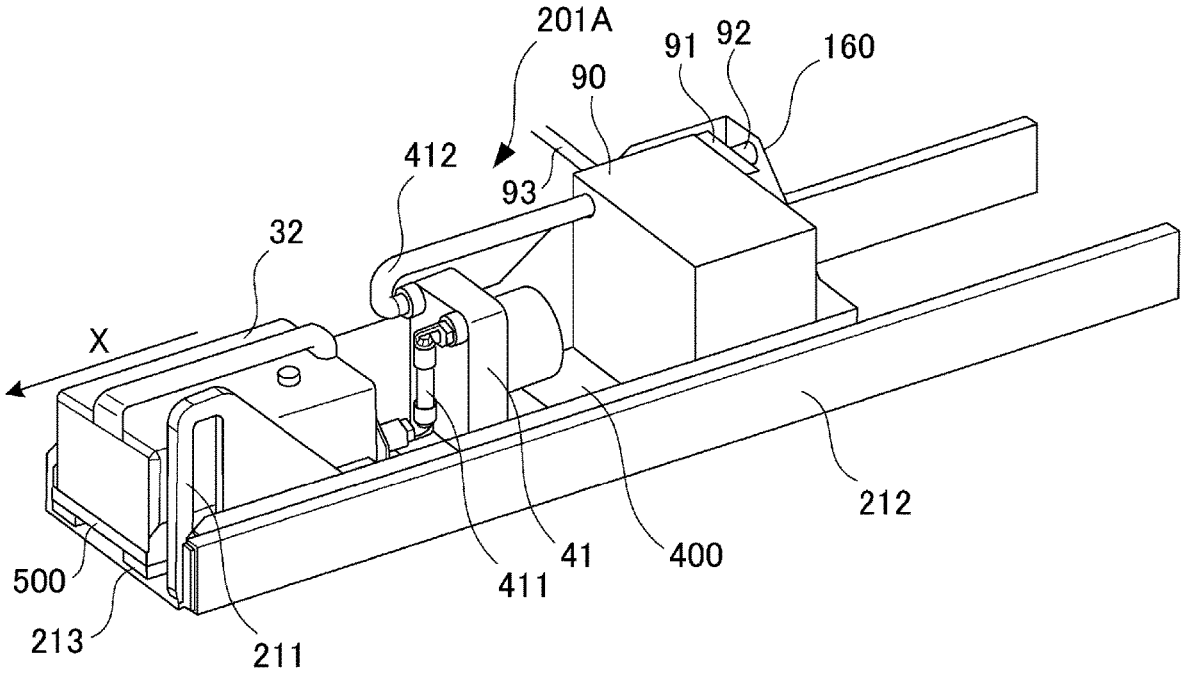
FIG. 12 is a perspective view showing a carrier supply unit including a container storing portion.

As shown in FIG. 12, to a carrier storing portion 90, the carrier liquid for supply is supplied from the carrier tank 32 through the liquid sending pipes 411 and 412 as a piping portion for the carrier liquid storing portion by the carrier supply pump 41. In addition, to the carrier storing portion 90, the separated carrier liquid is supplied from the separation and extraction device 34 through a liquid sending pipe 93. Then, from the carrier storing portion 90, the carrier liquid is sent to the mixer 31 through a liquid sending pipe 92 by a pump 91. That is, a carrier supply unit 201A includes the carrier storing portion 90, the pump 91 and the liquid sending pipe 92, in addition to the above-described members. When such a carrier storing portion 90 is provided, the carrier liquid can be efficiently utilized again. Even in the case of such a constitution, the is above-described embodiment is applicable.

Incidentally, in the above-described embodiment, the constitution in which only the toner tank 33 and the carrier tank 32 are capable of being drawn out was employed, but the present invention is not limited thereto. For example, the toner supply pump 42 (part (a) of FIG. 4), the carrier supply pump 41 (FIG. 5), and the like may also be capable of being drawn out together with the toner tank 33 and the carrier tank.

Incidentally, in the above-described embodiment, the case where the toner tank 33 and the carrier tank 32 are disposed in parallel with respect to the direction crossing the drawing direction was described as an example, but the present invention is not limited thereto. For example, the toner tank 33 and the carrier tank 32 may also be disposed vertically with respect to a direction of gravitation. A unit in such a case will be described using FIG. 13 and parts (a) and (b) of FIG. 14. However, in this case, constituent elements which are the same as those in the above-described embodiment are represented by the same reference numerals or symbols and will be briefly described or omitted from description. Further, although omitted from illustration, the carrier unit door 102 and the toner unit door 103 are provided to the apparatus main assembly 100*a* vertically with respect to the direction of gravitation, and only the toner door cover 105 is provided adjacent to the toner unit door 103 (FIG. 2).

Figure 13:
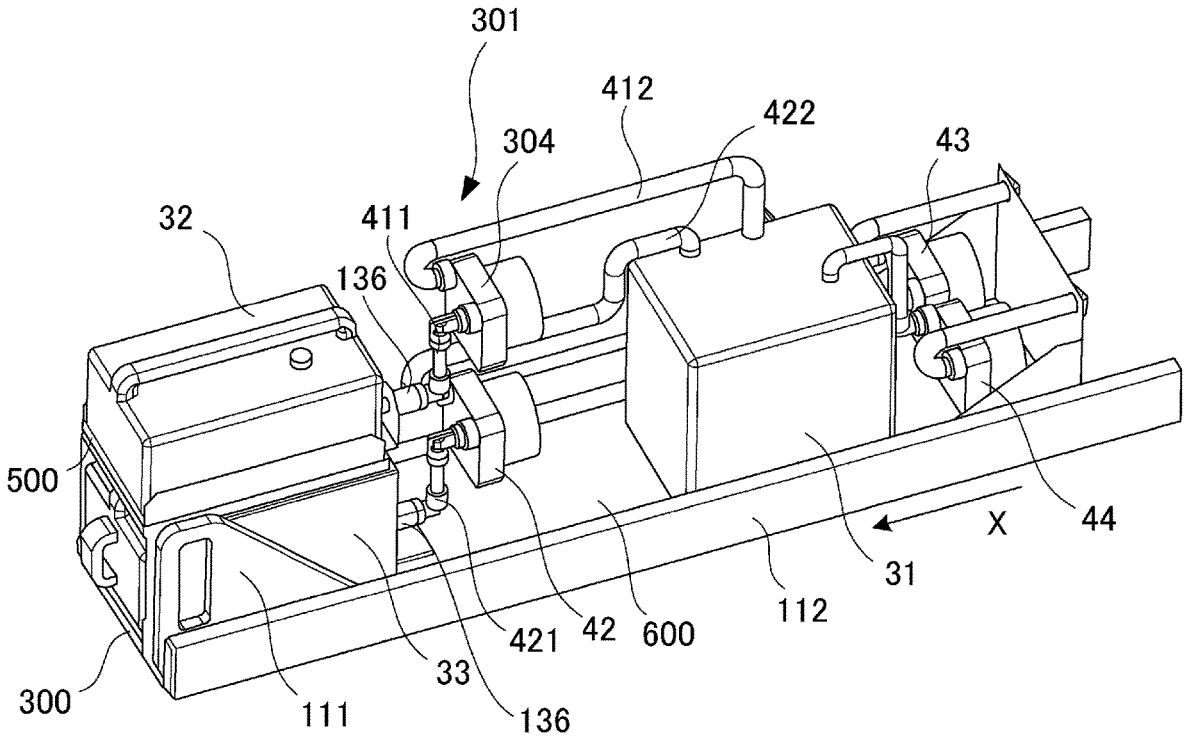
FIG. 13 is a perspective view showing a unit in another embodiment.

As shown in FIG. 13, a unit 301 is constituted so that the carrier tank table 500, the carrier supply pump 41 and the liquid sending pipes 411 and 412 are disposed above the toner supply unit 101 with respect to the direction of gravitation. The liquid sending pipe 412 is connected to the mixer 31. In the case of this embodiment, the toner tank 33, the carrier tank 32 and the connect 301 are capable of being integrally drawn out. That is, the user holds the handle 111 and then moves the unit 301 in the drawing direction in a state in which the toner door cover 105 is removed, so that the user is capable of integrally drawing out the toner tank 33, the carrier tank 32 and the unit 301. Thereafter, the user is capable of performing the maintenance of the unit 301.

Figure 14:
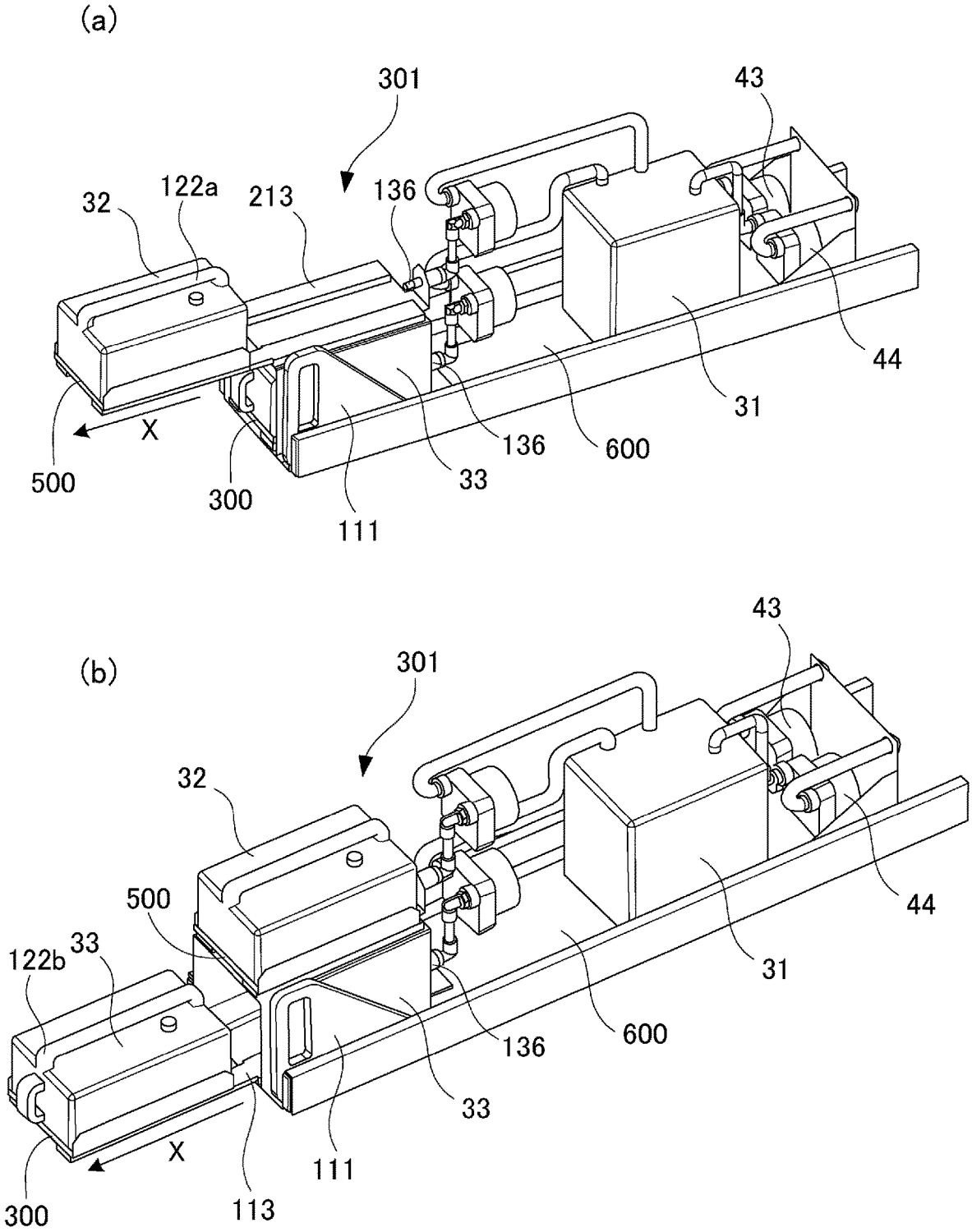
FIG. 14 includes views for illustrating a drawing mechanism for the unit shown in FIG. 13, in which part (a) shows a state in which a carrier tank is drawn out, and part (b) shows a state in which a toner tank is drawn out.

Further, as shown in part (a) of FIG. 14, the carrier tank table 500 is supported by a common unit table 600 so as to be slidable (movable) on the rail member 213. The user is capable of drawing out the carrier tank 32 from the apparatus main assembly 100*a* by moving the carrier tank 32 in the drawing direction while holding the gripping portion 122*a* of the carrier tank 32. At this time, in the case where the user does not remove the toner door cover 105 in advance, the user is capable of drawing out only the carrier tank 32 from the apparatus main assembly 100*a*, but cannot draw out the unit 301. That is, movement of the unit 301 in the drawing direction is restricted by the toner door cover 105, whereby the carrier tank table 500 moves relative to the common unit table 600, with the result that only the carrier tank 32 is drawn out of the apparatus main assembly 100*a*. Thereafter, the user is capable of exchanging the carrier tank 32.

Further, as shown in part (b) of FIG. 14, the toner tank table 300 is supported by a common unit table 600 so as to be slidable (movable) on the rail member 113. The user is capable of drawing out the toner tank 33 from the apparatus main assembly 100*a* by moving the toner tank 33 in the drawing direction while holding the gripping portion 122*b* of the toner tank 33. At this time, in the case where the user does not remove the toner door cover 105 in advance, the user is capable of drawing out only the toner tank 33 from the apparatus main assembly 100*a*, but cannot draw out the unit 301. That is, movement of the unit 301 in the drawing direction is restricted by the toner door cover 105, whereby the toner tank table 300 moves relative to the common unit table 600, with the result that only the toner tank 33 is drawn out of the apparatus main assembly 100*a*. Thereafter, the user is capable of exchanging the toner tank 33.

Incidentally, the liquid developer which remains on the developing roller 18 after the development and which is collected in the collecting section 16*b* of the developing device 16 may also be returned to the separation and extraction device 34. Incidentally, in the above-described embodiment, the case where the liquid developer used conventionally is used as the liquid developer used in the image forming apparatus 100 was described as an example, but the present invention is not limited thereto. For example, the case where as the liquid developer used in the image forming apparatus 100, a liquid developer of an ultraviolet curable type in which the liquid developer is cured by ultraviolet radiation may also be employed.

INDUSTRIAL APPLICABILITY

According to the present invention, there is provided an image forming apparatus of which is improved in maintenance property and which uses a liquid developer.

The present invention is not limited to the above-described embodiments, but can be variously changed and modified without departing from the spirit and the scope of the present invention. Accordingly, the following claims are attached for making the scope of the present invention public.

The present application claims priority on the basis of Japanese Patent Application No. 2018-106497 filed on Jun. 1, 2018, which is hereby incorporated by reference herein in its entirety.

The invention claimed is:

1. An image forming apparatus comprising:

an apparatus main assembly;

a drawer portion provided so as to be capable of being drawn out of said apparatus main assembly;

an image forming portion, provided in said apparatus main assembly, for forming an image with a liquid developer containing toner and a carrier liquid;

a supply container accommodating one of toner for supply and a carrier liquid for supply; and a unit provided between said image forming portion and said supply container in a feeding passage of the liquid developer, wherein said supply container and said unit are provided in said drawer portion.

2. An image forming apparatus according to claim 1, wherein said supply container is provided on a side downstream of said unit with respect to a drawing direction of said drawer portion.

3. An image forming apparatus according to claim 2, wherein said supply container is provided for movement toward and away from said unit, and wherein said drawer portion includes:

a unit holding portion holding said unit and capable of being drawn out of said apparatus main assembly; and a container holding portion provided on said unit holding portion, wherein said container holding portion holds said supply container and is movable in the drawing direction relative to said unit holding portion.

4. An image forming apparatus according to claim 3, comprising a restricting member capable of restricting drawing of said unit holding portion from said apparatus main assembly.

5. An image forming apparatus according to claim 1, comprising:

another supply container, provided for movement toward and away from said unit, for accommodating the other one of the toner for supply and the carrier liquid for supply; and another drawer portion provided so as to be capable of being drawn out of said apparatus main assembly, wherein said another supply container is provided in said another drawer portion.

6. An image forming apparatus according to claim 5, wherein said another drawer portion is disposed in parallel to said drawer portion with respect to a direction crossing the drawing direction.

7. An image forming apparatus according to claim 3, comprising:

another supply container, provided for movement toward and away from said unit, for accommodating the other one of the toner for supply and the carrier liquid for supply; and another container holding portion provided on said unit holding portion, wherein said another container holding portion holds said another supply container and is movable in the drawing direction relative to said unit holding portion.

8. An image forming apparatus according to claim 7, wherein said container holding portion and said another container holding portion are disposed vertically with respect to a direction of gravitation.

9. An image forming apparatus according to claim 1, wherein said supply container is a toner container for accommodating the toner for supply, and wherein said unit includes a mixing device for forming the liquid developer by mixing and dispersing the toner and the carrier liquid.

10. An image forming apparatus according to claim 9, wherein said unit includes a pump for a toner mixing device for sending the toner for supply from said toner container to said mixing device and includes a piping portion for said toner mixing portion.

11. An image forming apparatus according to claim 1, wherein said supply container is a toner container for accommodating the toner for supply, and wherein said unit includes a toner storing portion for temporarily storing the toner.

12. An image forming apparatus according to claim 11, wherein said unit includes a pump for said toner storing portion for sending the toner for supply from said toner container to said toner storing portion and includes a piping portion for said toner storing portion.

13. An image forming apparatus according to claim 1, wherein said supply container is a carrier container for accommodating the carrier liquid for supply, and wherein said unit includes a mixing device for forming the liquid developer by mixing and dispersing the toner and the carrier liquid.

14. An image forming apparatus according to claim 13, wherein said unit includes a pump for a carrier mixing device for sending the carrier liquid for supply from said carrier container to said mixing device and includes a piping portion for said carrier mixing device.

15. An image forming apparatus according to claim 1, comprising:

a separation and extraction device for separating the liquid developer, sent from said image forming portion, into the toner and the carrier liquid, wherein said supply container is a carrier container for accommodating the carrier liquid for supply, and wherein said unit includes a carrier storing portion for storing the carrier liquid for supply sent from said carrier container and the carrier liquid separated by said separation and extraction device.

16. An image forming apparatus according to claim 15, wherein said unit includes a pump for said carrier storing portion for sending the carrier liquid from said carrier container to said carrier storing portion and includes a piping portion for said carrier storing portion.

17. An image forming apparatus according to claim 1, wherein the liquid developer is a liquid developer of an ultraviolet curable type in which the liquid developer is cured by ultraviolet radiation.

* * * * *